US011765540B2

(12) United States Patent
You et al.

(10) Patent No.: US 11,765,540 B2
(45) Date of Patent: Sep. 19, 2023

(54) METHOD AND APPARATUS FOR CONTROLLING SOUND ACCORDING TO SEAT POSTURE IN VEHICLE

(71) Applicants: HYUNDAI MOTOR COMPANY, Seoul (KR); Kia Corporation, Seoul (KR)

(72) Inventors: Jung Keun You, Suwon-si (KR); Myoung Ok Lee, Seoul (KR); Kaang Dok Yee, Seoul (KR)

(73) Assignees: HYUNDAI MOTOR COMPANY, Seoul (KR); KIA, CORPORATION, Seoul (KR)

( * ) Notice: Subject to any disclaimer, the term of this patent is extended or adjusted under 35 U.S.C. 154(b) by 0 days.

(21) Appl. No.: 17/545,280

(22) Filed: Dec. 8, 2021

(65) Prior Publication Data

US 2023/0035325 A1 Feb. 2, 2023

(30) Foreign Application Priority Data

Jul. 29, 2021 (KR) ..... 10-2021-0099942

(51) Int. Cl.
*H04S 7/00* (2006.01)
*H04R 5/02* (2006.01)

(52) U.S. Cl.
CPC ..... *H04S 7/303* (2013.01); *H04R 5/02* (2013.01); *H04R 2499/13* (2013.01)

(58) Field of Classification Search
CPC ..... H04S 7/303; H04R 5/02; H04R 2499/13
See application file for complete search history.

(56) References Cited

U.S. PATENT DOCUMENTS

| | | | | |
|---|---|---|---|---|
| 2018/0352362 | A1* | 12/2018 | Volkmar | H04S 7/303 |
| 2019/0077345 | A1* | 3/2019 | Choi | B60R 16/037 |
| 2019/0116421 | A1* | 4/2019 | Kano | H04R 3/04 |
| 2021/0120359 | A1* | 4/2021 | Tatum | H04R 1/403 |
| 2021/0266652 | A1* | 8/2021 | Winton | H04R 1/025 |
| 2021/0377654 | A1* | 12/2021 | Oswald | B60N 2/64 |

FOREIGN PATENT DOCUMENTS

JP 2019186654 A * 10/2019

OTHER PUBLICATIONS

Machine translation of JP2019186654; Nakamura, Oct. 2019.*

* cited by examiner

*Primary Examiner* — Andrew L Sniezek
(74) *Attorney, Agent, or Firm* — Morgan, Lewis & Bockius LLP

(57) ABSTRACT

A method and apparatus of controlling a sound using an audio system in a vehicle, includes receiving seat posture information related to a seat by occupied an occupant among seats in a vehicle, determining at least one speaker to output a sound among a plurality of speakers in the vehicle according to the seat posture information, and generating a control signal to control the sound output by the at least one speaker according to the seat posture information.

16 Claims, 16 Drawing Sheets

METHOD AND APPARATUS FOR CONTROLLING SOUND ACCORDING TO SEAT POSTURE IN VEHICLE

CROSS-REFERENCE TO RELATED APPLICATION

The present application claims priority to Korean Patent Application No. 10-2021-0099942, filed on Jul. 29, 2021, the entire contents of which is incorporated herein for all purposes by this reference.

BACKGROUND a. Field of the Invention

The present invention relates to a method and an apparatus for controlling a sound in a vehicle, and more specifically, to a method of controlling a sound according to a seat posture and an audio mode in a vehicle.

b. Related Art

The contents described in the present section merely provide background information for an exemplary embodiment of the present invention and do not constitute the related art.

Vehicles denote apparatuses capable of traveling on roads and transporting persons or things to destinations. The vehicles may mainly travel to various locations using one or more wheels provided on vehicle bodies.

A vehicle provides a navigation function, a phone function, an audio function, a radio function, and the like. Recently, the vehicle is provided with various hardware and software to perform various and complex functions.

Functions required by a driver or passenger in a vehicle are also becoming more and more complex. For example, among passengers of a vehicle, a driver wants to receive voice guidance for navigation, and a passenger wants to listen to music. Furthermore, in a case in which a driver makes a call through Bluetooth connection in a vehicle, the driver may want a passenger to not hear the conversation for privacy reasons.

Therefore, research on technology for separating a sound output region or sound reaching region to allow only a passenger positioned at a preset region to listen a sound in a vehicle is recently conducted.

Meanwhile, research on autonomous vehicles which autonomously move to destinations according to the degree of driver intervention in vehicles is actively conducted.

Since the autonomous vehicle have little or no dependence on the driver, not only a passenger but also the driver may freely act in the autonomous vehicle. Due to an autonomous driving function of the autonomous vehicle, an internal structure may be variously formed by changing positions and postures of seats. The passengers may sit to face each other and conduct a conference. Furthermore, the passengers may also sit in opposite directions and perform individual tasks.

However, in the conventional vehicle, since positions of speakers are fixed, and the number of the speakers is small, there is a problem in that it is difficult for the vehicle to provide an active audio function according to a change of seat.

The information disclosed in this Background of the Invention section is only for enhancement of understanding of the general background of the invention and may not be taken as an acknowledgement or any form of suggestion that this information forms the prior art already known to a person skilled in the art.

SUMMARY

Various aspects of the present invention are directed to providing a method of controlling a sound using an audio system in a vehicle. The method includes receiving seat posture information related to a seat occupied by an occupant among seats in a vehicle. The method also includes determining at least one speaker to output a sound among a plurality of speakers in the vehicle according to the seat posture information. The method also includes generating a control signal to control the sound output by the at least one speaker according to the seat posture information.

According to various exemplary embodiments of the present invention, various aspects of the present invention provide a sound control apparatus. The sound control apparatus includes a receiving unit configured to receive seat posture information related to a seat occupied by an occupant among seats in a vehicle. The sound control apparatus also includes a control unit configured to determine at least one speaker to output a sound among a plurality of speakers provided in the vehicle according to the seat posture information and generate a control signal to control the sound output by the at least one speaker according to the seat posture information.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
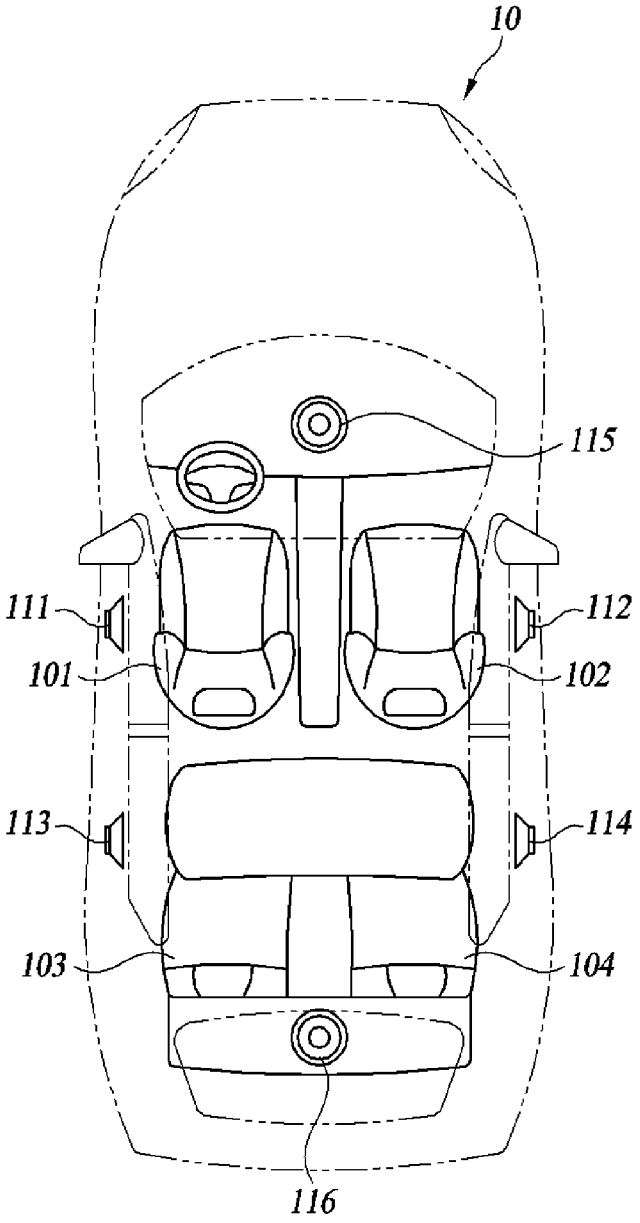
FIG. 1 is a view exemplarily illustrating an example of a plurality of speakers and a plurality of seats in a vehicle according to various exemplary embodiments of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Embodiments of the present invention provide a method and an apparatus of determining a speaker to output a sound according to a seat posture and controlling the sound of the speaker.

Other embodiments of the present invention provide a method and an apparatus of determining a speaker to output a sound according to a seat posture and an audio mode and controlling the sound of the speaker.

Hereinafter, various exemplary embodiments of the present invention are described with reference to the drawings. It should be noted that in giving reference numerals to components of the accompanying drawings, the same or equivalent components are denoted by the same reference numerals even when the components are illustrated in different drawings. In describing the present invention, when determined that a detailed description of related known functions or configurations may obscure the subject matter of the present invention, the detailed description thereof has been omitted.

Furthermore, in describing the components of the present invention, terms such as first, second, A, B, (a), (b), etc. may be used. These terms are used only to distinguish any component from other components, and features, sequences, or the like, of corresponding components are not limited by these terms. Throughout the exemplary embodiment, unless explicitly described to the contrary, "including" and "comprising" any components should be understood to imply the inclusion of other elements rather than the exclusion of any other elements. A term, such as "part," "module," or the like described in the specification, means a unit of processing at least one function or operation and may be implemented as hardware or software or a combination of hardware and software. When a component, device, element, or the like of the present invention is referred to as having a purpose or performing an operation, function, or the like, the component, device, or element should be considered herein as being "configured to" meet that purpose or to perform that operation or function.

FIG. 1 is a view exemplarily illustrating an example of a plurality of speakers and a plurality of seats in a vehicle according to various exemplary embodiments of the present invention.

Referring to FIG. 1, a vehicle 10 includes a plurality of seats 101, 102, 103, and 104 and a plurality of speakers 111, 112, 113, 114, 115, and 116 therein.

In FIG. 1, a type of the vehicle 10 is a type of a car according to various exemplary embodiments of the present invention. In another exemplary embodiment of the present invention, a vehicle 10 may be one type of a bus, a truck, a train, and the like.

In FIG. 1, positions and the numbers of the plurality of speakers 111, 112, 113, 114, 115, and 116 and the plurality of seats 101, 102, 103, and 104 correspond to various exemplary embodiments of the present invention. The plurality of speakers 111, 112, 113, 114, 115, and 116 and the plurality of seats 101, 102, 103, and 104 may be provided at any position, and there is no limit to the number thereof.

In FIG. 1, six speakers 111, 112, 113, 114, 115, and 116 disposed in the vehicle 10 are illustrated. A first speaker 111 is provided on a side door of a first seat 101. A second speaker 112 is provided on a side door of a second seat 102. A third speaker 113 is provided on a side door of a third seat 103. A fourth speaker 114 is provided on a side door of a fourth seat 104. A fifth speaker 115 is provided at a front side in the vehicle 10. A sixth speaker 116 is provided at a rear side in the vehicle 10.

The plurality of seats 101, 102, 103, and 104 are seats on which passengers sit.

The plurality of speakers 111, 112, 113, 114, 115, and 116 are devices which output sounds.

A sound control apparatus of the vehicle 10 generates a sound control signal to be output through the plurality of speakers 111, 112, 113, 114, 115, and 116. For example, the sound control apparatus may generate a music play signal, a video play signal, a voice call signal, a navigation guide signal, and various warning signals. The plurality of speakers 111, 112, 113, 114, 115, and 116 may output a sound signal in the vehicle 10 based on the sound control signal.

The plurality of speakers 111, 112, 113, 114, 115, and 116 may generate constructive interference or destructive interference with respect to a sound signal in a low frequency band a sound signal in a middle and high frequency band in the vehicle 10. That is, a sound may be output to some regions in the vehicle 10 according to the number and a layout of the plurality of speakers 111, 112, 113, 114, 115, and 116.

Figure 2:
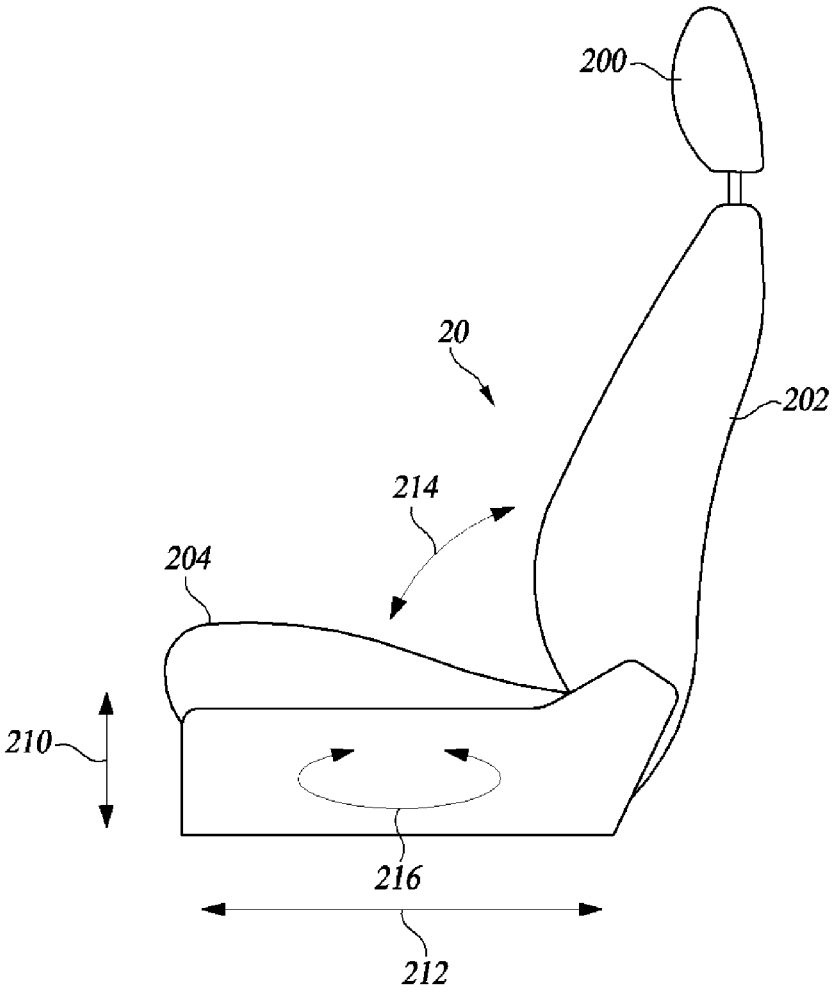
FIG. 2 is a view for describing a seat posture according to various exemplary embodiments of the present invention.

FIG. 2 is a view for describing a seat posture according to various exemplary embodiments of the present invention.

Referring to FIG. 2, a seat 20, a headrest 200, a backrest 202, a seat cushion 204, a seat height 210, a sliding position 212, a backrest angle 214, and a seat rotation angle 216 are illustrated.

The seat 20 includes the headrest 200, the backrest 202, and the seat cushion 204. The seat 20 may have various postures according to adjustment of the headrest 200, the backrest 202, and the seat cushion 204.

Posture information of the seat 20 includes at least one of the seat height 210, the sliding position 212, the backrest angle 214, or the seat rotation angle 216. The posture information of the seat 20 may further include a position of the seat 20 in the vehicle. The position of the seat 20 may be identified according to identification information of the seat 20. For example, the position of the seat 20 may be identified as a position of a driver's seat, a passenger seat, or a seat behind the driver's seat.

The seat height 210 denotes a height of the seat 20. The seat height 210 may denote a vertical height from the floor of the vehicle.

The sliding position 212 expresses horizontal movement of the seat 20. For example, the sliding position 212 may express a position on an axis in a front and rear direction of the vehicle. Furthermore, the sliding position 212 may express a position on an axis in a lateral direction of the vehicle. The sliding position 212 of the seat 20 may be adjusted along a rail provided on the floor of the vehicle.

The backrest angle 214 expresses an angle between the seat cushion 204 and the backrest 202. The backrest angle 214 may denote an angle between the seat cushion 204 and the backrest 202 on a plane perpendicular to the floor of the vehicle. The plane perpendicular to the floor of the vehicle may have a normal vector pointing to the left or right of the vehicle. The backrest angle 214 may be expressed using sensing information of a Hall sensor provided in the seat 20.

The seat rotation angle 216 expresses horizontal rotation of the seat 20. The seat 20 may rotate horizontally on the floor of the vehicle. The seat 20 may rotate in a clockwise or counterclockwise direction thereof. The seat rotation angle 216 may be an angle measured based on a forward direction of the vehicle.

Furthermore, the posture information of the seat 20 may include a height of the backrest 202, a height of the headrest 200, an angle of the headrest 200, a height of a front side of the seat cushion 204, a height of a rear side of the seat cushion 204, or the like.

The angle of the headrest 200 may denote an angle between the headrest 200 and a plane perpendicular to the floor of the vehicle. The plane perpendicular to the floor of the vehicle may have a normal vector pointing to the front or rear of the vehicle.

Figure 3:
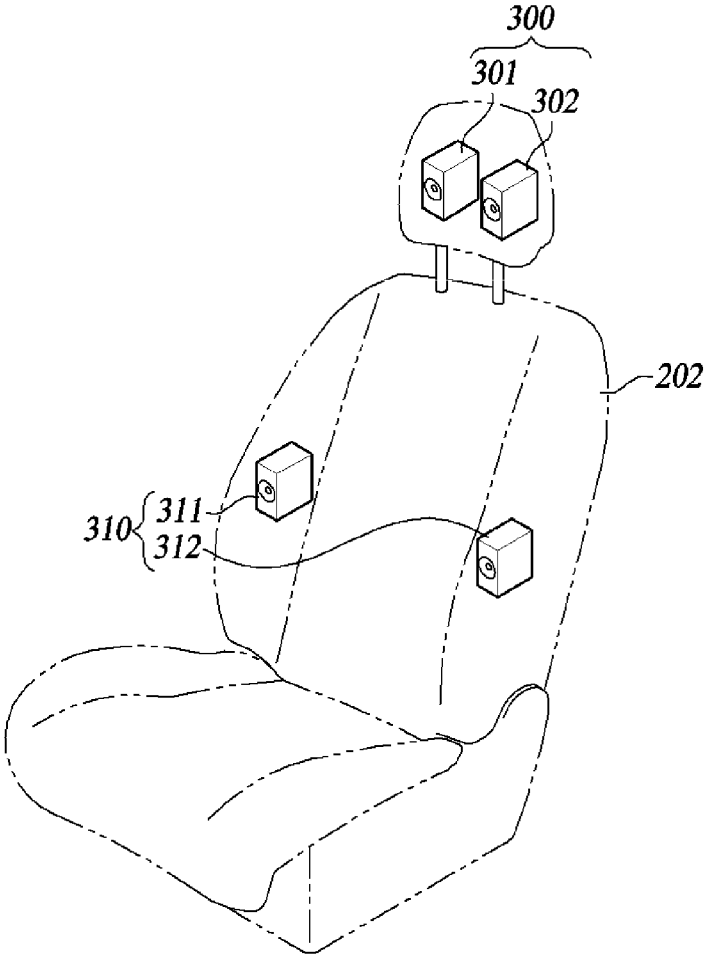
FIG. 3 is a view exemplarily illustrating an example of a speaker disposed in the seat according to various exemplary embodiments of the present invention.

FIG. 3 is a view exemplarily illustrating an example of a speaker disposed in the seat according to various exemplary embodiments of the present invention.

Referring to FIG. 3, the headrest 200, the backrest 202, headrest speakers 300, and backrest speakers 310 are illustrated.

The headrest 200, the backrest 202, the headrest speakers 300, and the backrest speakers 310 may be disposed on or in the seat. In FIG. 3, positions, the numbers, and shapes of the headrest speakers 300 and the backrest speakers 310 are an exemplary embodiment of the present invention. In another exemplary embodiment of the present invention, headrest speakers 300 and backrest speakers 310 may have various positions, numbers, and shapes.

The headrest speakers 300 include a right headrest speaker 301 and a left headrest speaker 302.

The headrest speakers 300 may be provided in the headrest 200 of the seat and output a sound to the driver or passenger who sits on the seat. The headrest speakers 300 may be disposed in each of the seats in the vehicle.

The headrest speakers 300 may be provided in the headrest 200 at predetermined angles. Since the headrest speakers 300 are provided to be inclined in directions toward ears of the passenger who sits on the seat, the passenger may effectively listen to the sound output from the headrest speakers 300.

The backrest speakers 310 include a right backrest speaker 311 and a left backrest speaker 312.

The backrest speakers 310 may be provided in the backrest 202 of the seat and output a sound to the driver or passenger who sits on the seat. The backrest speakers 310 may be disposed in each of the seats in the vehicle.

The backrest speakers 310 may be disposed in the backrest 202 at predetermined angles. Since the backrest speakers 310 are provided to be inclined in directions toward the body of the passenger who sits on the seat, the passenger can effectively listen to the sound output from the backrest speakers 310.

The headrest speakers 300 and the backrest speakers 310 may be used to separate a sound between a region which a sound reach and a region which a sound does not reach in an internal region of the vehicle. Furthermore, headrest speakers 300 and the backrest speakers 310 may be used to improve a sound field separation effect for each seat. That is, the headrest speakers 300 and the backrest speaker 310 may be used to improve a sound contrast between an output region and a non-output region. For example, an occupant who sits on the seat may easily listen to a sound from the headrest speakers 300 and the backrest speakers 310, and it is difficult for other occupant who sits on another seat to listen to the sound from the headrest speakers 300 and the backrest speakers 310.

Figure 4:
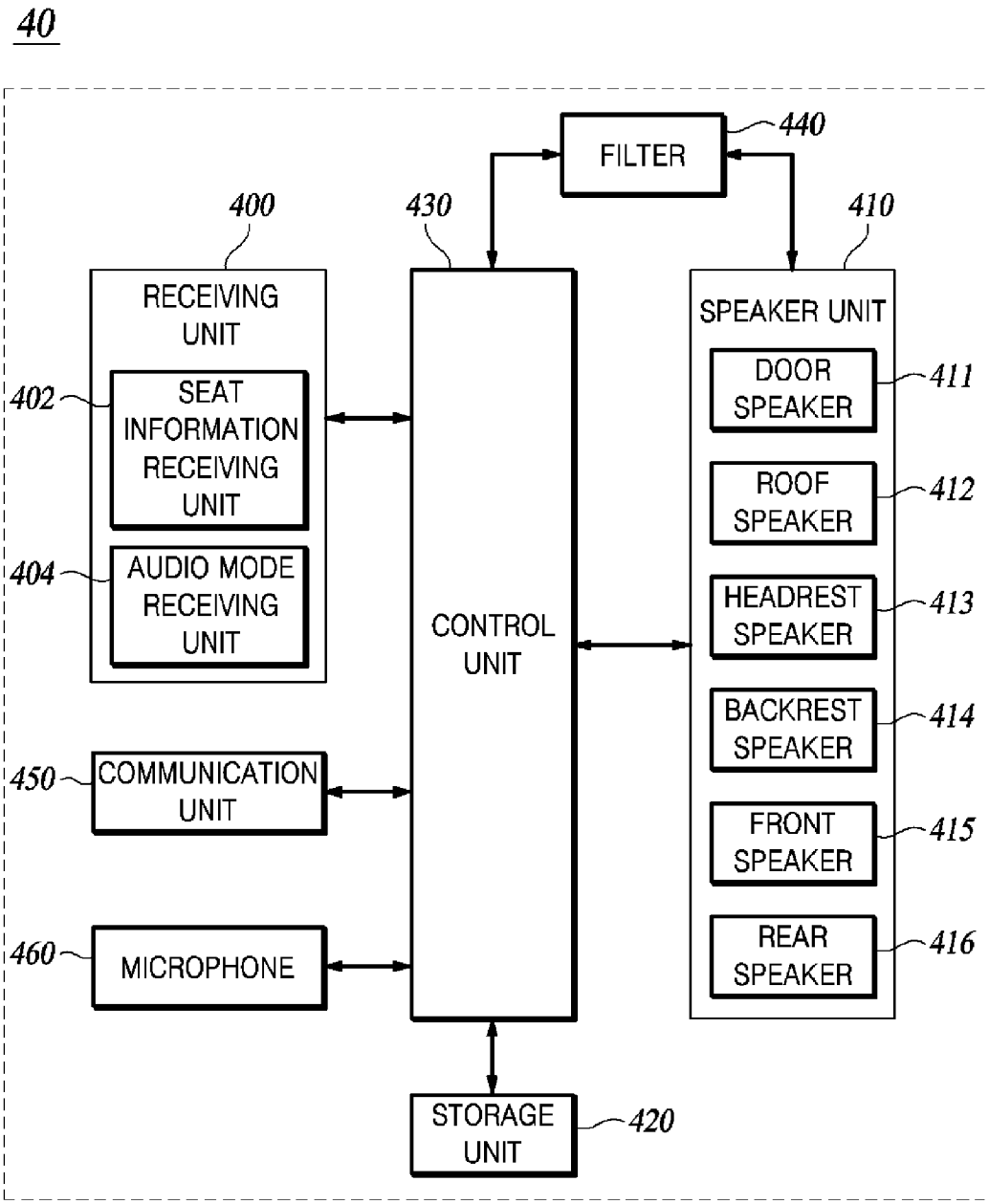
FIG. 4 is a schematic diagram illustrating a sound control system according to various exemplary embodiments of the present invention.

FIG. 4 is a schematic diagram illustrating a sound control system according to various exemplary embodiments of the present invention.

Referring to FIG. 4, a vehicle 40 may include some or all of a receiving unit 400, a speaker unit 410, a storage unit 420, a control unit 430, a filter 440, a communication unit 450, and a microphone 460. The vehicle 40 may further include an amplifier to allow the control unit 430 to control the speaker unit 410. The components may be devices or logics embedded in the vehicle 40.

A sound control apparatus according to various exemplary embodiments of the present invention may include the receiving unit 400 and the control unit 430. The sound control apparatus may also further include other components.

The receiving unit 400 receives seat posture information related to at least one seat occupied by at least one occupant in the vehicle 40. The receiving unit 400 may further receive an audio mode from an occupant who sits on a seat.

In the instant case, the seat posture information includes at least one of a seat position, a seat height, a sliding position, a backrest angle, or a seat rotation angle. The audio mode includes at least one of a basic mode, a road noise canceling mode, an independent sound field mode, a voice curtain mode, a privacy call mode, a noise vibration harness (NVH) canceling mode, or a noise canceling mode.

The receiving unit 400 may include at least one of a seat information receiving unit 402 or an audio mode receiving unit 404.

The seat information receiving unit 402 receives the seat posture information through a sensor provided in the seat or a sensor provided in the vehicle. The seat information receiving unit 402 may receive the seat posture information from each seat disposed in the vehicle 40.

The seat information receiving unit 402 may receive at least one of the seat height, the sliding position, the backrest angle, or the seat rotation angle through a Hall effect sensor provided in the seat.

The Hall effect denotes a phenomenon in which, when a magnetic field is generated to be perpendicular to a current in a state in which the current flows through a conductor, a potential difference is generated in a direction perpendicular to the current in the conductor in which the current flows. Since an operation of the Hall effect sensor is clear to those skilled in the art, a detailed description thereof will be omitted.

In addition to the sensor provided in the seat, the seat information receiving unit 402 may also receive the seat posture information using a sensor such as a camera, radar, LiDAR, or ultrasonic sensor provided in the vehicle. That is, the seat information receiving unit 402 may receive at least one of the seat position, the seat height, the sliding position, the backrest angle, or the seat rotation angle through the sensor provided in the vehicle.

The audio mode receiving unit 404 receives an audio mode from the occupant through a user interface. The audio mode receiving unit 404 may receive the audio mode for each occupant of each seat. The user interface includes various interfaces such as a graphic interface, an audio interface, and a touch interface.

The audio mode may include at least one of the basic mode, the road noise canceling mode, the independent sound field mode, the voice curtain mode, the privacy call mode, the noise, vibration, and harshness (NVH) canceling mode, or the noise canceling mode.

The speaker unit 410 is a component which outputs a sound. The speaker unit 410 outputs a sound based on a sound control signal generated by the control unit 430.

The speaker unit 410 may be divided into a tweeter, a squawker, a woofer, or a subwoofer according to a frequency band. The tweeter outputs a sound in a high frequency band, the squawker outputs a sound in a middle frequency band, and the woofer outputs a sound in a low frequency band, and the subwoofer outputs a sound in an ultra-low frequency band.

The speaker unit 410 may also be divided into a general type speaker, a vibration type speaker, or a film type speaker. The general speaker denotes a conventional speaker. The vibration type speaker is a speaker for generating vibrations in a low frequency band. The film type speaker has a thin film shape and outputs a sound through vibration of a film. Since the film type speaker has a small volume, the film type speaker may be mainly used in a small space.

The speaker unit 410 may include at least one speaker. Referring to FIG. 4, the speaker unit 410 may include at least one of a door speaker 411, roof speakers 412, a headrest speaker 413, a backrest speaker 414, a front speaker 415, or a rear speaker 416. The speakers may output a sound in a fixed frequency band or a variable frequency band.

The door speaker 411, the headrest speaker 413, the backrest speaker 414, the front speaker 415, and the rear speaker 416 are the same as those described with reference to FIGS. 1 and 3.

The roof speaker 412 is a speaker disposed on a roof of the vehicle 40 to face toward an interior of the vehicle 40.

The roof speakers 412 may be disposed on a straight line, and the straight line may have one of various angles based on a forward direction of the vehicle 40. Furthermore, the roof speakers 412 may also be disposed on two intersecting straight lines.

The vehicle 40 may provide more audio channels than a conventional vehicle through the roof speaker 412.

The storage unit 420 stores programs and data which relate to the method of controlling a sound according to the exemplary embodiment of the present invention.

For example, the storage unit 420 may include a program for the control unit 430 to perform the method of controlling a sound. The storage unit 420 may store the seat posture information and the audio mode. The storage unit 420 may store information for determining the speaker unit 410 to correspond to at least one of the seat posture information or the audio mode. The storage unit 420 may store a sound pressure level and a frequency band of the speaker unit 410 to correspond to at least one of the seat posture information or the audio mode.

The control unit 430 determines at least one speaker to output a sound among a plurality of speakers in the vehicle 40, based on the seat posture information. The control unit 430 generates a control signal to control the sound output by at least one speaker based on the seat posture information.

In the instant case, the control signal includes at least one of a control signal relating to a sound pressure level or a control signal relating to a frequency band. Furthermore, the control signal includes a sound signal to be output.

According to various exemplary embodiments of the present invention, the control unit 430 may use pre-stored information to determine at least one speaker to output the sound and generate the control signal of the at least one speaker.

The control unit 430 may determine at least one speaker, which is preset to correspond to the seat posture information, as at least one speaker to output a sound. The at least one speaker may be determined with reference to a look-up table defining at least one speaker corresponding to the seat posture information. For example, the storage unit 420 may store a distance from the speaker unit 410 according to the seat posture information or information relating to whether any speaker is to be used according to the distance. The control unit 430 may determine a close speaker as at least one speaker to output the sound according to the seat posture information.

The control unit 430 may generate a control signal to make at least one speaker, which is determined as at least one speaker to output a sound among the plurality of speakers, output a sound at a preset sound pressure level in a preset frequency band. The preset sound pressure level and the preset frequency band correspond to the seat posture information. To the present end, the storage unit 420 may store sound pressure levels and frequency bands of at least one speaker according to the seat posture information.

According to various exemplary embodiments of the present invention, the control unit 430 may use a distance from the seat to at least one speaker to determine at least one speaker to output a sound. The control unit 430 may generate a control signal for the determined speaker.

To determine at least one speaker to output a sound, the control unit 430 estimates a head position of the occupant who sits on the seat based on the seat posture information. The control unit 430 may determine at least one speaker based on distances from the head position of the occupant to the plurality of speakers. The at least one determined speaker outputs a sound according to a control signal of the control unit 430.

The control unit 430 may estimate the head position of the occupant who sits on the seat based on the seat posture information, and generate the control signal based on the distance between the head position of the occupant and at least one speaker. In the instant case, the at least one speaker of the plurality of speakers may also be a speaker predetermined to correspond to the seat posture information or also be a speaker determined according to the distance to the head position of the occupant.

The control unit 430 may generate a control signal to control at least one speaker, which is determined as a speaker to output a sound, to output a sound at a higher sound pressure level as the at least one determined speaker is close to the head position of the occupant.

The control unit 430 may generate a control signal to control at least one speaker, which is determined as a speaker to output a sound, to output a sound in a lower frequency band as the at least one determined speaker is close to the head position of the occupant.

As the control unit 430 concentrates an output on at least one speaker close to the head position of the occupant, the occupant can receive a vivid sound service.

According to various exemplary embodiments of the present invention, the control unit 430 may determine at least one speaker to output a sound among the plurality of speakers in the vehicle 40, based on the seat posture information and the audio mode. Furthermore, the control unit 430 may generate a control signal to control a sound output by at least one speaker based on the seat posture information and the audio mode. Examples in which the control unit 430 determines a speaker and generates a control signal based on the seat posture information and the audio mode are illustrated in FIGS. 6A, 6B, 7A, 7B, 8A, 8B, 9A, and 9B.

The control unit 430 may generates a control signal to control at least one speaker to output a sound in a wider frequency band as the at least one speaker is close to the head position of the occupant. For example, the control unit 430 may perform sound masking by controlling a headrest speaker close to the head position of the occupant to output a sound in a wide frequency band in the road noise canceling mode. The sound masking denotes a technology of generating band noise such as white noise to prevent an occupant from recognizing noise.

The control unit 430 may generate a control signal to control a sound output from at least one speaker to reach the head position of the occupant, based on the seat posture information and the audio mode.

The control unit 430 may generate a control signal to generate constructive interference for a sound signal at the head position of the occupant. The control unit 430 may generate a control signal to control sound signals output by at least one speaker so that a sound is output to only one region instead of an entire region in the vehicle 40 using constructive interference according to a phase difference. For example, the control unit 430 may implement the independent sound field mode and the noise, vibration, and harshness (NVH) canceling mode using the constructive interference.

The control unit 430 may generate a control signal to control a sound output by at least one speaker to reach the head position instead of a region excluding the head position of the occupant, based on the seat posture information and the audio mode.

The control unit 430 may generate a control signal to generate constructive interference for a sound signal at the head position of the occupant, and generate destructive interference at a region excluding the head position of the occupant. The control unit 430 may generate a control signal so that sound signals, which are output by at least one speaker, make a sound to be output to only one region and not be output to other regions through constructive interference and destructive interference according to a phase difference. For example, the control unit 430 may implement the voice curtain mode and the privacy call mode using constructive interference and destructive interference.

The control unit 430 may provide a sound service to each seat or passenger through beam forming.

Information relating to constructive interference and destructive interference caused by a combination of sound signals output by the plurality of speakers may be preset and stored in the storage unit 420.

Furthermore, the control unit 430 may generate a control signal to control a sound output by at least one speaker based on the audio mode and a distance between the head position of the occupant and the at least one speaker.

The filter 440 may filter sound signals output by the plurality of speakers.

Constructive interference or destructive interference may be generated for sound signals output by at least one speaker according to a constructive interference control signal and a destructive interference control signal generated by the control unit 430. However, as the control signals generated by the control unit 430 are filtered as preset types through the filter 440, there may also be an effect in that each of the speakers may generate constructive interference or destructive interference.

An algorithm in a form of a transfer function may be implemented as the filter 440, and the filter 440 may allow a sound control signal generated by the control unit 430 in a specific frequency band to be removed or to pass therethrough to output a sound signal output from at least one speaker to a specific region, or to cancel the sound signal which is output to other regions.

As a sound output control signal generated by the control unit 430 passes through the filter 440 so that the sound output control signal in a specific frequency band is removed or passes therethrough, a sound signal may be output to only a specific region through at least one speaker. The filter 440 may optimize a signal generated by the control unit 430 to effectively transmit a sound signal output by at least one speaker to a specific region.

The communication unit 450 communicates with an external apparatus outside the vehicle 40.

The communication unit 450 may communicate with a terminal of the occupant or an infrastructure. For example, the communication unit 450 may receive audio data played in the terminal of the occupant from the terminal, and the speaker unit 410 of the vehicle 40 may output the audio data received through the communication unit 450. Furthermore, the communication unit 450 may receive call contents received by the occupant terminal from a base station.

The microphone 460 receives a voice in the vehicle 40. The microphone 460 may implement an audio interface of the vehicle 40.

The microphone 460 receives a voice of the occupant to allow the control unit 430 to set the audio mode.

The microphone 460 may receive an audio signal in the vehicle 40. The control unit 430 may implement the NVH canceling mode or noise canceling mode based on the audio signal received by the microphone 460. The control unit 430 may output band noise into the vehicle 40 through the speaker unit 410 to prevent the passenger from recognizing noise. Furthermore, the control unit 430 may output a sound opposite to the noise through the speaker unit 410 to cancel the noise. Furthermore, the control unit 430 may perform feedback control on an audio signal and a sound signal received by the microphone 460. That is, the control unit 430 may properly adjust an audio environment and a sound output through the speaker unit 410 in the vehicle 40.

Figure 5:
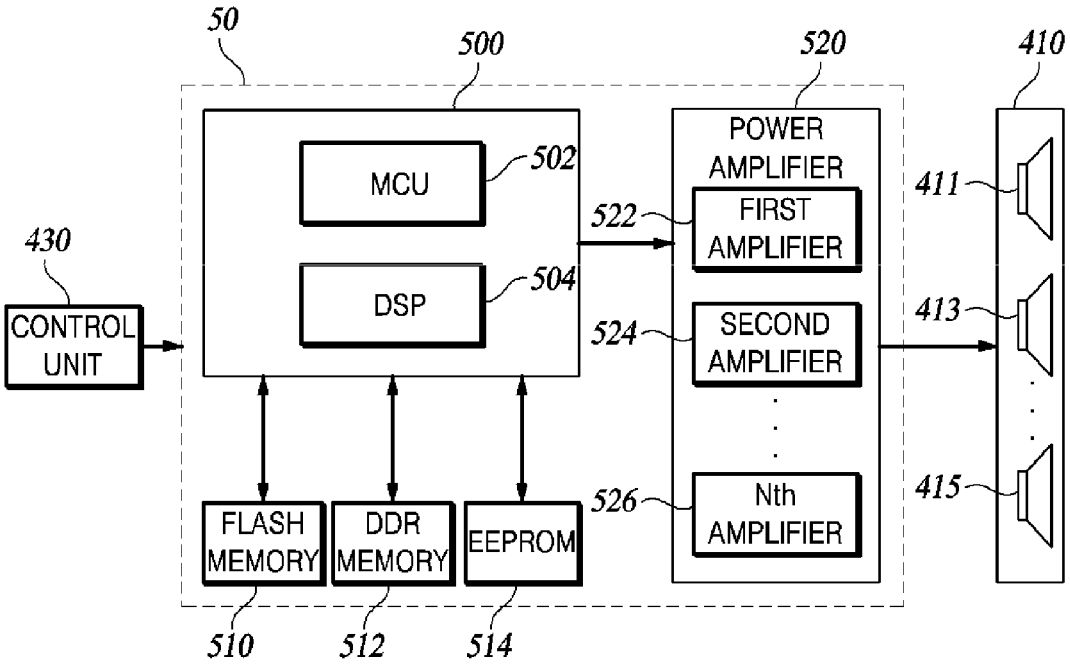
FIG. 5 is a schematic diagram illustrating a speaker control system according to various exemplary embodiments of the present invention.

FIG. 5 is a schematic diagram illustrating a speaker control system according to various exemplary embodiments of the present invention.

Referring to FIG. 5, the control unit 430, an amplifier 50, and the speaker unit 410 are illustrated.

The amplifier 50 includes a micro control unit (MCU) 502, a digital signal processor (DSP) 504, a flash memory 510, a double data rate (DDR) memory 512, an electrically erasable programmable read-only memory (EEPROM) 514, a first amplifier 522, a second amplifier 524, and an Nth amplifier 526.

The speaker unit 410 includes the plurality of speakers 412, 413, and 415. The MCU 502 and the DSP 504 may be integrated as an amplifier control unit 500. The first amplifier 522, second amplifier 524, and the Nth amplifier 526 may be collectively referred to as a power amplifier 520. Meanwhile, the number of the amplifiers may be variously adjusted.

The control unit 430 outputs a sound to the occupant using the amplifier 50 and the speaker unit 410.

The amplifier 50 is an apparatus which amplifies a sound control signal received from the control unit 430 and transmits the amplified sound control signal to the speaker unit 410. The speaker unit 410 outputs a sound according to the amplified sound control signal.

The amplifier 50 may also perform not only a function of amplifying a sound source signal using the MCU 502 and the DSP 504 but also a function of adjusting a frequency thereof.

The MCU 502 controls the overall operation of the amplifier 50.

The DSP 504 denotes a data processor which converts analog signal information into a digital signal expressed using "0" and "1" to mathematically process the analog signal information.

The amplifier control unit 500 may perform filtering, amplifying, and noise canceling of a specific signal, signal generation, signal detection, feature detection of a signal, and the like. Furthermore, the amplifier control unit 500 may control functions of equalizer adjustment, audio mux, volume control, voice recognition, voice memo, and a digital theater system (DTS).

The power amplifier 520 amplifies a control signal of the control unit 430 according to control of the amplifier control unit 500. A power integrated circuit (IC) may be implemented as the power amplifier 520. The power amplifier 520 may have one audio channel for each amplifier.

The flash memory 510, the DDR memory 512, and the EEPROM 514 store pieces of information required for operation of the amplifier control unit 500.

The amplifier 50 may adjust a control signal of the control unit 430 to allow the control unit 430 to control a sound of the speaker unit 410 according to the seat posture information and the audio mode.

Figure 6A:
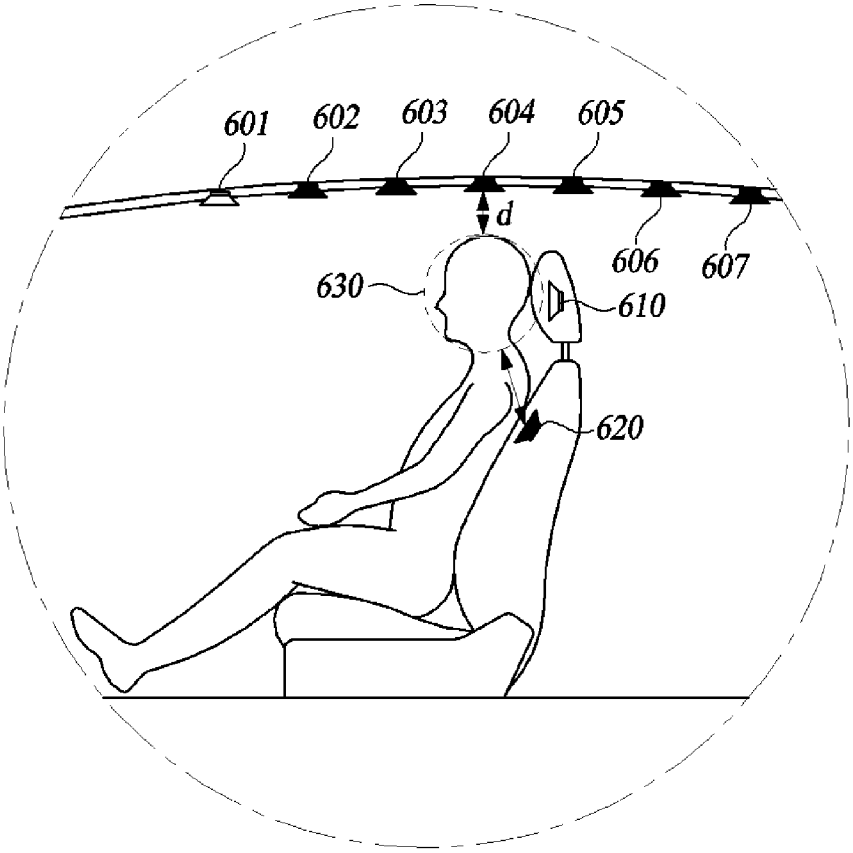
FIG. 6A and FIG. 6B are views for describing an example of a method of controlling a sound according to various exemplary embodiments of the present invention.
Figure 6B:
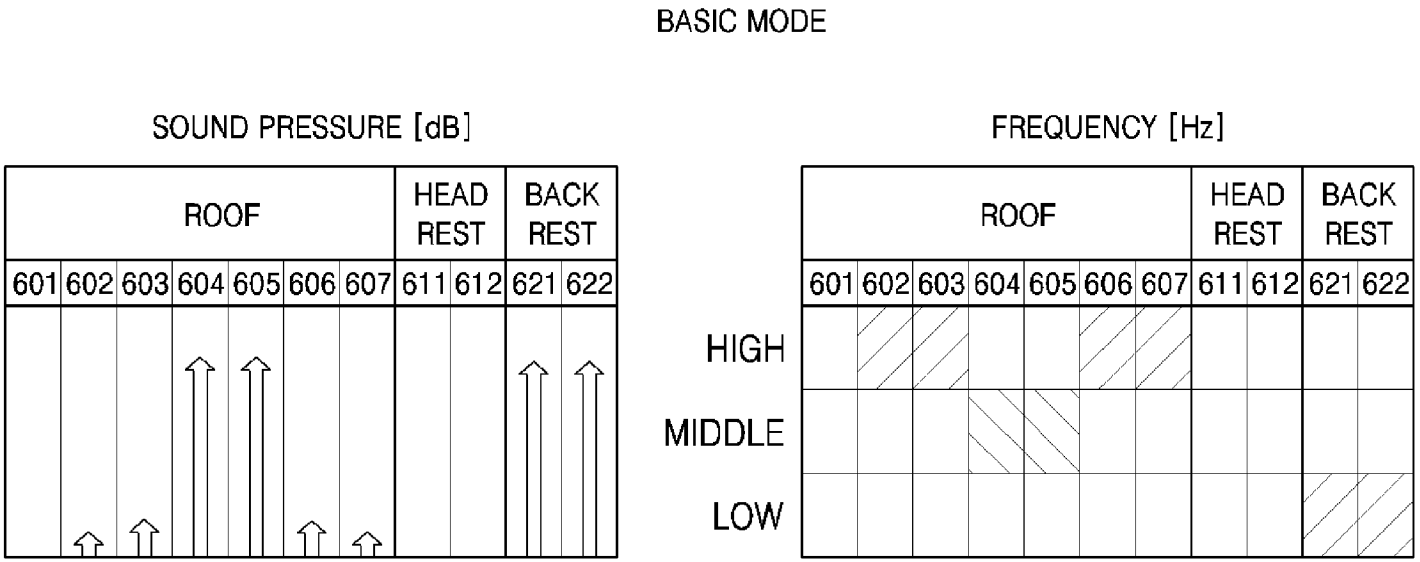

FIG. 6A and FIG. 6B are views for describing an example of a method of controlling a sound according to various exemplary embodiments of the present invention.

Referring to FIG. 6A and FIG. 6B, a plurality of roof speakers 601, 602, 603, 604, 605, 606, and 607, a headrest speaker 610, a backrest speaker 620, and a head position 630 of an occupant are illustrated.

The plurality of roof speakers 601, 602, 603, 604, 605, 606, and 607 includes a first roof speaker 601, a second roof speaker 602, a third roof speaker 603, a fourth roof speaker 604, a fifth roof speaker 605, a sixth roof speaker 606, and a seventh roof speaker 607.

The headrest speaker 610 may include a right headrest speaker 611 and a left headrest speaker 612.

The backrest speaker 620 may include a right backrest speaker 621 and a left backrest speaker 622.

In FIG. 6A, the number and positions of the speakers correspond to an exemplary embodiment of the present invention, and in another exemplary embodiment of the present invention, the number and positions of speakers may be changed.

Referring to FIG. 6B, sound pressures and frequencies of the plurality of roof speakers 601, 602, 603, 604, 605, 606, and 607 are illustrated according to seat posture information illustrated in FIG. 6A.

Referring to FIG. 6A and FIG. 6B, a sound control apparatus receives the seat posture information related to a seat in a vehicle.

According to various exemplary embodiments of the present invention, the sound control apparatus determines at least one speaker to output a sound among the plurality of speakers, based on the seat posture information. In FIG. 6A, the seat has a posture facing the front of the vehicle. Among the plurality of roof speakers 601, 602, 603, 604, 605, 606, and 607, the sound control apparatus may select the second roof speaker 602, the third roof speaker 603, the fourth roof speaker 604, the fifth roof speaker 605, the sixth roof speaker 606, and the seventh roof speaker 607 based on the seat posture information. Furthermore, the sound control apparatus may select the backrest speaker 620 based on the seat posture information.

In various exemplary embodiments of the present invention, the selected speakers may be speakers preset to correspond to the seat posture information. When a seat posture faces the front of the vehicle, and the backrest is perpendicular to the floor, the sound control apparatus may determine the second roof speaker 602, the third roof speaker 603, the fourth roof speaker 604, the fifth roof speaker 605, the sixth roof speaker 606, the seventh roof speaker 607, and the backrest speaker 620 as output speakers according to prestored information.

In another exemplary embodiment of the present invention, a sound control apparatus may estimate a head position 630 of an occupant and select a speaker to output a sound based on distances between the head position 630 of the occupant and speakers. The sound control apparatus may determine a second roof speaker 602, a third roof speaker 603, a fourth roof speaker 604, a fifth roof speaker 605, a sixth roof speaker 606, a seventh roof speaker 607, and a backrest speaker 620 which are close to the head position 630 of the occupant as output speakers.

According to various exemplary embodiments of the present invention, a sound control apparatus may generate a control signal to control a sound pressure level and a frequency band output by a speaker based on seat posture information.

In various exemplary embodiments of the present invention, the sound control apparatus may set a sound pressure level and a frequency band, which are prestored to correspond to the seat posture information, for each speaker. In another exemplary embodiment of the present invention, a sound control apparatus may set a sound pressure level and a frequency band for each speaker based on a distance between a head position 630 of an occupant and a speaker.

Among the plurality of roof speakers 601, 602, 603, 604, 605, 606, and 607, the sound control apparatus may set sound pressure levels of the fourth roof speaker 604, the fifth roof speaker 605, and the backrest speaker 620, which are close to the head position 630 of the occupant, to be high. On the other hand, the sound control apparatus may set sound pressure levels of the second roof speaker, the third roof speaker 603, the sixth roof speaker 606, and the seventh roof speaker 607, which are relatively far from the head position 630 of the occupant, to be low.

Among the plurality of roof speakers 601, 602, 603, 604, 605, 606, and 607, the sound control apparatus may control the fourth roof speaker 604 and the fifth roof speaker 605, which are close to the head position 630 of the occupant, to output a sound in a middle frequency band. The sound control apparatus may control the backrest speaker 620 to output a sound in a low frequency band. The backrest speaker 620 is configured as a woofer speaker. On the other hand, the sound control apparatus may control the second roof speaker, the third roof speaker 603, the sixth roof speaker 606, and the seventh roof speaker 607, which are relatively far from the head position 630 of the occupant, to output a sound in a high frequency band.

Figure 7A:
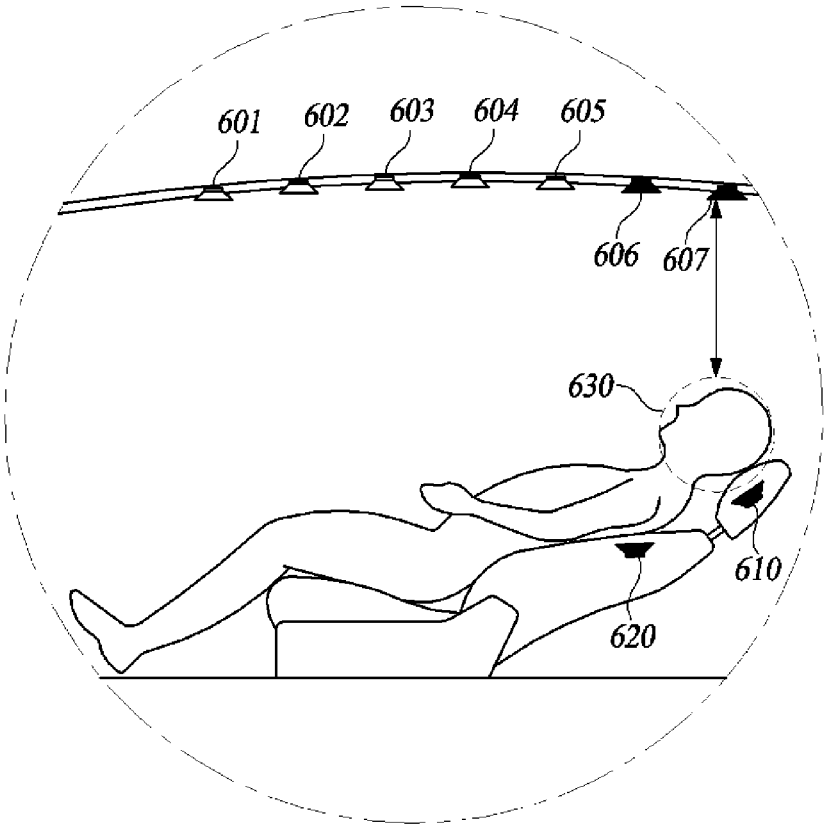
FIG. 7A and FIG. 7B are views for describing an example of a method of controlling a sound according to a seat posture according to various exemplary embodiments of the present invention.
Figure 7B:
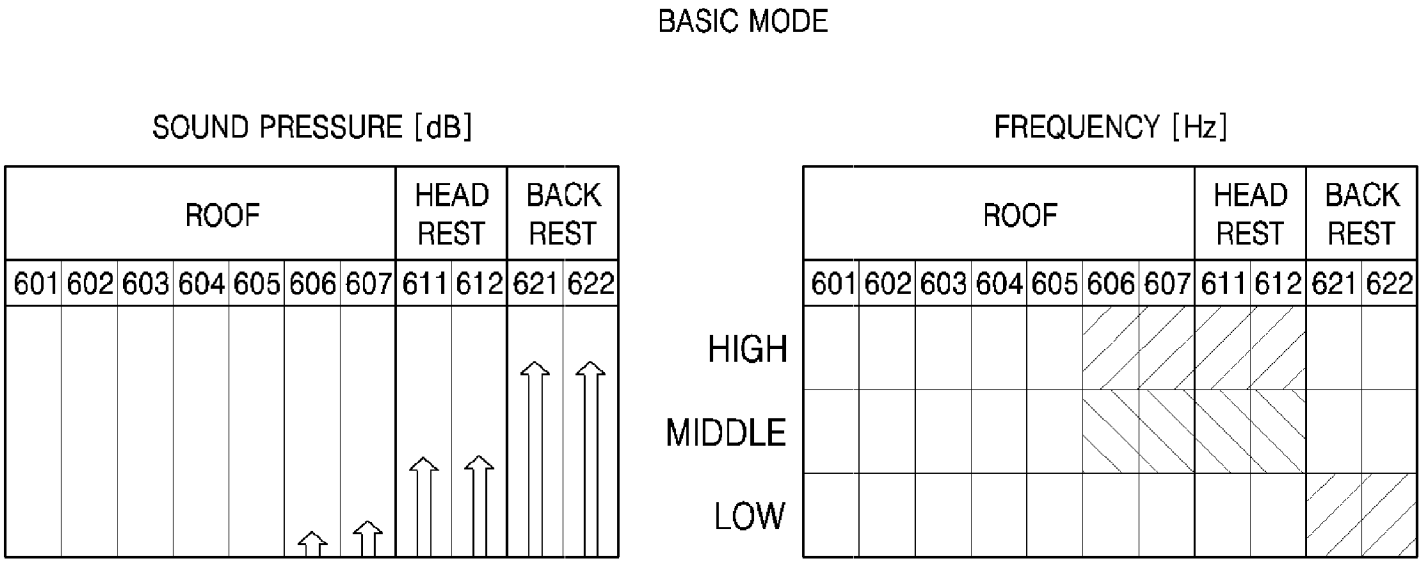

FIG. 7A and FIG. 7B are views for describing an example of a method of controlling a sound according to a seat posture according to various exemplary embodiments of the present invention;

Referring to FIG. 7A and FIG. 7B, the posture of the seat is changed to be different from that of FIG. 6A and FIG. 6B. The seat faces the front of the vehicle, and the backrest reclined. The sound control apparatus receives the changed seat posture information related to the seat in the vehicle.

The sound control apparatus may use information pre-stored to correspond to the seat posture information. However, hereinafter, the sound control apparatus will be described based on an exemplary embodiment in which the head position 630 of the occupant is used.

Unlike FIG. 6A and FIG. 6B, in FIG. 7A, the sound control apparatus may determine the sixth roof speaker 606, the seventh roof speaker 607, the headrest speaker 610, and the backrest speaker 620 which are close to the head position 630 of the occupant as output speakers.

In FIG. 7B, among the plurality of roof speakers 601, 602, 603, 604, 605, 606, and 607, the sound control apparatus may set a sound pressure level of the backrest speaker 620, which is close to the head position 630 of the occupant, to be high. On the other hand, the sound control apparatus may set sound pressure levels of the sixth roof speaker 606 and the seventh roof speaker 607, which are relatively far from the head position 630 of the occupant, to be low.

Among the plurality of roof speakers 601, 602, 603, 604, 605, 606, and 607, the sound control apparatus may control the backrest speaker 620, which is close to the head position 630 of the occupant, to output a sound in a low frequency band. On the other hand, the sound control apparatus may control the sixth roof speaker 606 and the seventh roof speaker 607, which are relatively far from the head position 630 of the occupant, to output sounds in a middle frequency band and a high frequency band.

Referring to FIGS. 6A, 6B, 7A and 7B, the sound control apparatus may determine a speaker to output a sound based on the seat posture information and control a sound pressure level and a frequency band of the speaker. Accordingly, even when a posture of a seat is variously changed in an autonomous vehicle, the sound control apparatus can provide a customized audio service.

Figure 8A:
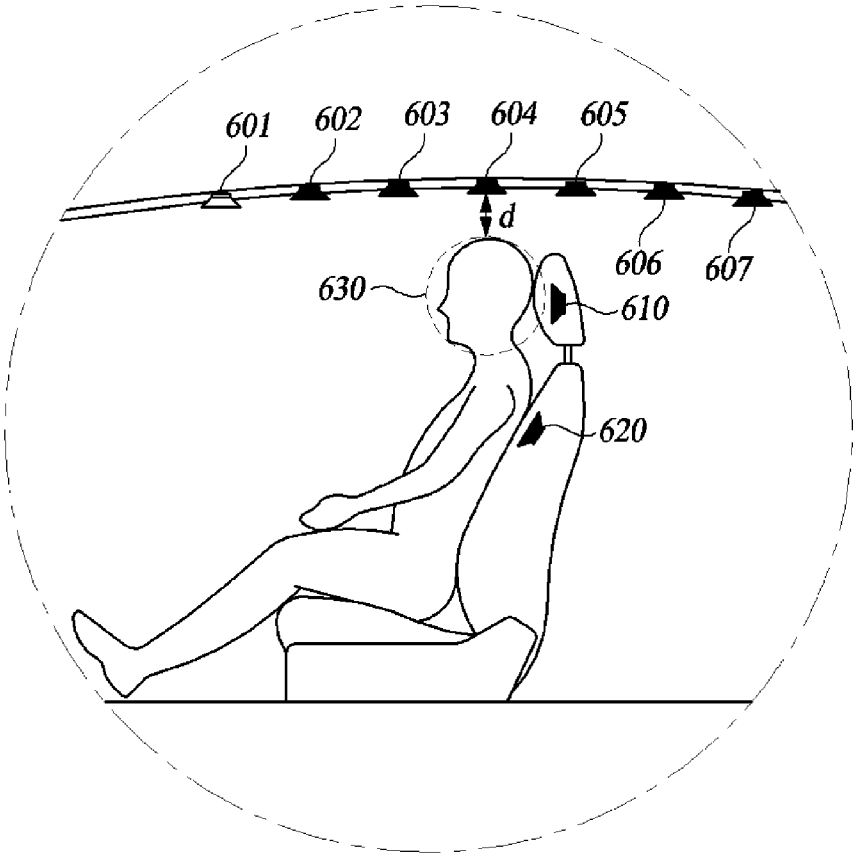
FIG. 8A and FIG. 8B are views for describing an example of a method of controlling a sound according to an audio mode according to various exemplary embodiments of the present invention.
Figure 8B:
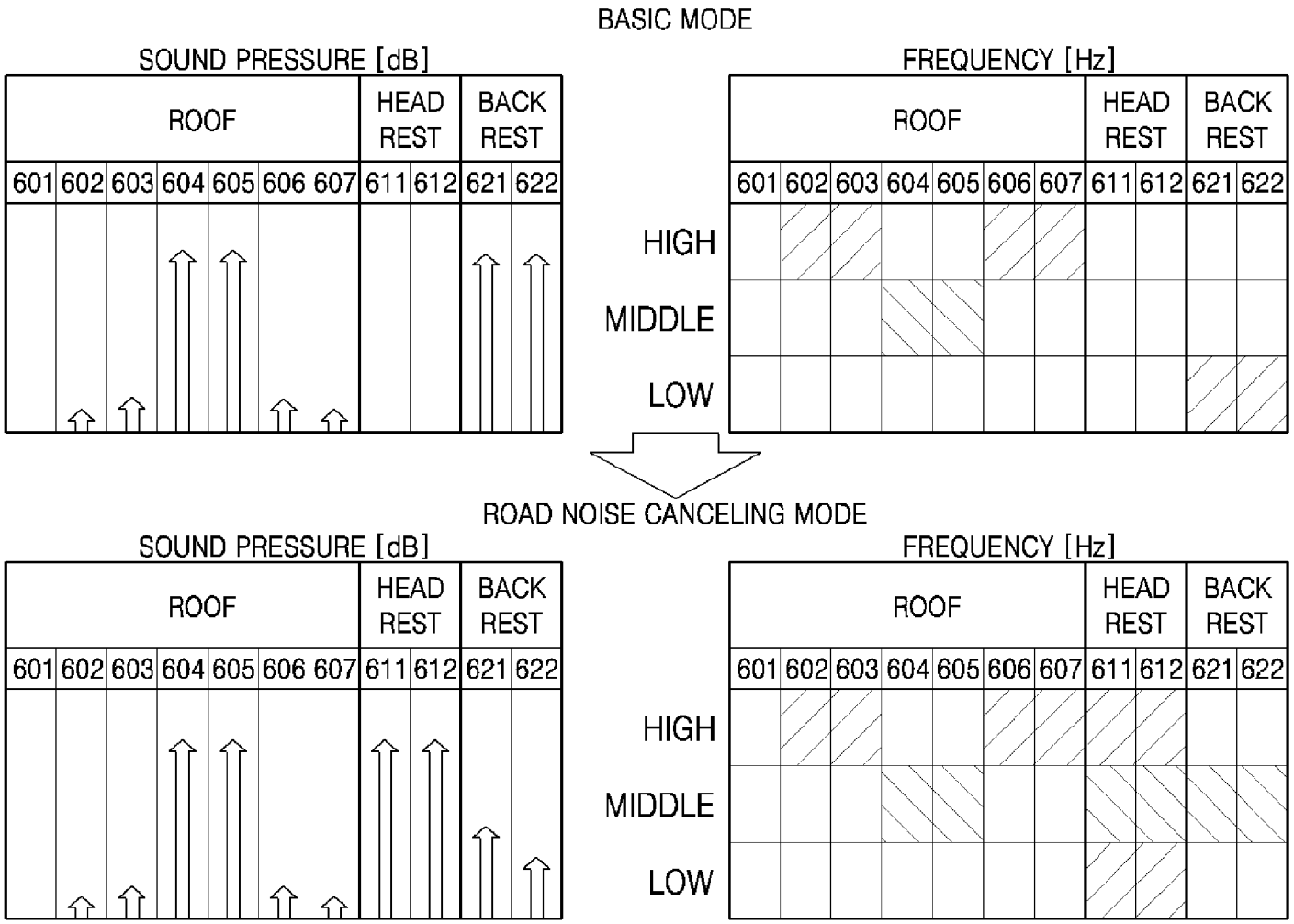

FIG. 8A and FIG. 8B are views for describing an example of a method of controlling a sound according to an audio mode according to various exemplary embodiments of the present invention.

The sound control apparatus receives not only the seat posture information related to the seat in the vehicle but also the audio mode.

Among the plurality of speakers, the sound control apparatus determines at least one speaker to output a sound based on the seat posture information and the audio mode.

Among the plurality of speakers, the sound control apparatus may determine at least one speaker to output a sound based on the audio mode and distances d between the head position 630 of the occupant and the speakers.

Referring to FIGS. 8A and 8B, when the audio mode is a basic mode, among the plurality of roof speakers 601, 602, 603, 604, 605, 606, and 607, the sound control apparatus may determine the second roof speaker 602, the third roof speaker 603, the fourth roof speaker 604, the fifth roof speaker 605, the sixth roof speaker 606, and the seventh roof speaker 607 as speakers to output a sound by considering the seat posture information.

Referring to FIGS. 8A and 8B, the sound control apparatus may receive a road noise canceling mode from the occupant and change at least one speaker to output a sound according to the road noise canceling mode. The sound control apparatus may additionally determine the headrest speaker 610 as at least one speaker to output a sound according to the road noise canceling mode unlike the basic mode.

After the speaker is determined, the sound control apparatus may control a sound pressure level and a frequency band of the speaker based on the seat posture information and the audio mode.

Referring to FIG. 8B, the sound control apparatus controls the backrest speaker 620 to output a sound in a low frequency band in the basic mode. Accordingly, when the sound control apparatus receives the road noise canceling mode, the sound control apparatus may change the control to control the backrest speaker 620 to output a sound in a middle frequency band. Furthermore, the sound control apparatus may set a sound pressure level of the headrest speaker 610 to be high in the road noise canceling mode and control the headrest speaker 610 to output a sound in a wide frequency band. Accordingly, the headrest speaker 610 may generate band noise in an entire frequency band to perform sound masking to prevent the occupant from recognizing ambient noise.

Meanwhile, when the audio mode is changed in various exemplary embodiments of the present invention, the sound control apparatus may determine a speaker, which is close to the head position 630 of the occupant, and generate a control signal to make the determined speaker output a sound in at a high sound pressure level in a low frequency band.

Furthermore, the sound control apparatus may receive an independent sound field mode from the occupant. The sound control apparatus may control sound pressure levels, frequency bands, and phases of the speakers to output a sound to the head position 630 of the occupant according to the independent sound field mode.

Figure 9A:
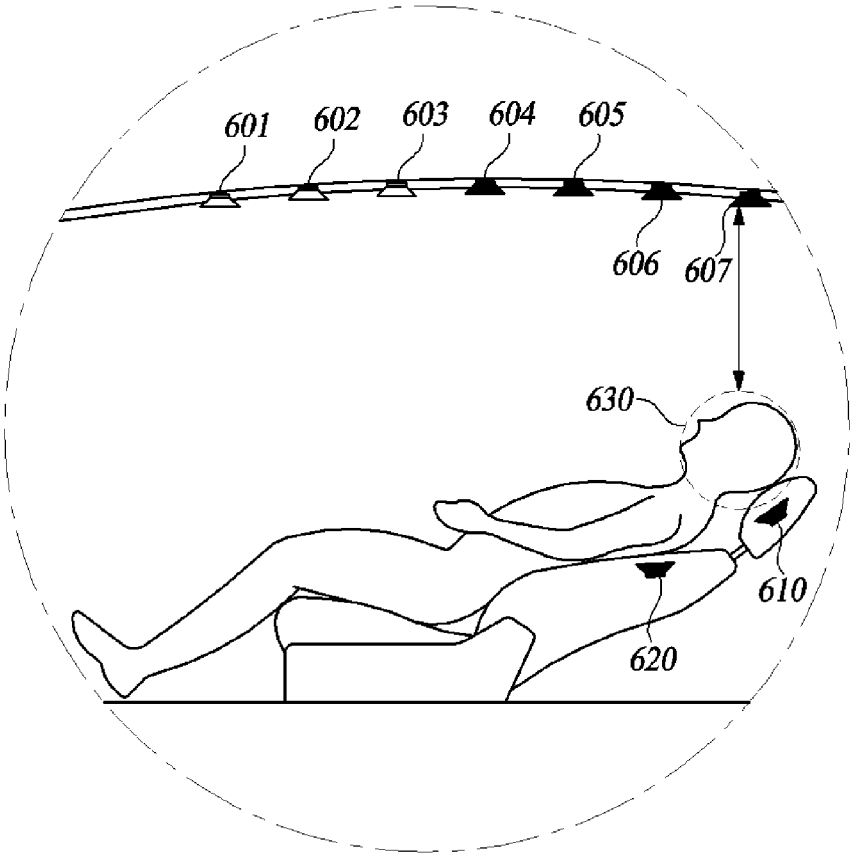
FIG. 9A and FIG. 9B are views for describing an example of a method of controlling a sound according to a seat posture and an audio mode according to various exemplary embodiments of the present invention.
Figure 9B:
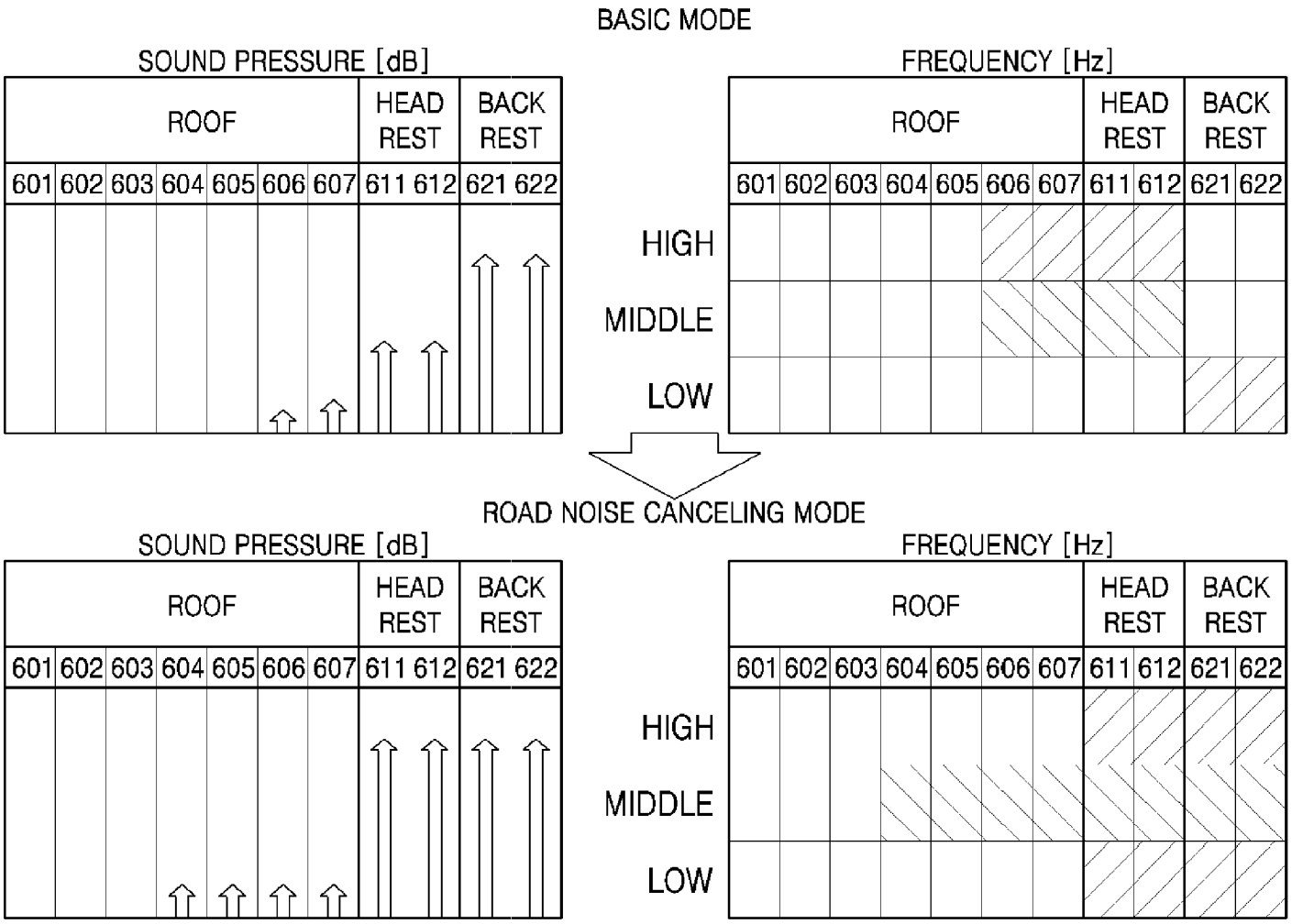

FIG. 9A and FIG. 9B are views for describing an example of a method of controlling a sound according to a seat posture and an audio mode according to various exemplary embodiments of the present invention.

Referring to FIGS. 7A and 9B, when the audio mode is the basic mode, the sound control apparatus may determine the sixth roof speaker 606, the seventh roof speaker 607 among the plurality of roof speakers 601, 602, 603, 604, 605, 606, and 607, the headrest speaker 610, and the backrest speaker 620 as speakers to output a sound by considering seat posture information.

Referring to FIG. 9A and FIG. 9B, even when the sound control apparatus receives the road noise canceling mode from the occupant, the sound control apparatus may not change the speakers to output the sound.

However, the sound control apparatus may control a sound pressure level and a frequency band of at least one speaker based on the seat posture information and the audio mode.

Referring to FIG. 9B, the sound control apparatus controls the backrest speaker 620 to output a sound in a low frequency band in the basic mode. Furthermore, the sound control apparatus controls the headrest speaker 610 to output a sound in a middle frequency band and a high frequency band in the basic mode. Accordingly, when the sound control apparatus receives the road noise canceling mode, the sound control apparatus may control the headrest speaker 610 and the backrest speaker 620 to output sounds in the entire frequency band. Furthermore, the sound control apparatus may increase a sound pressure level of the headrest speaker 610. Furthermore, the sound control apparatus may further use the fourth roof speaker 604 and the fifth roof speaker 605.

Figure 10:
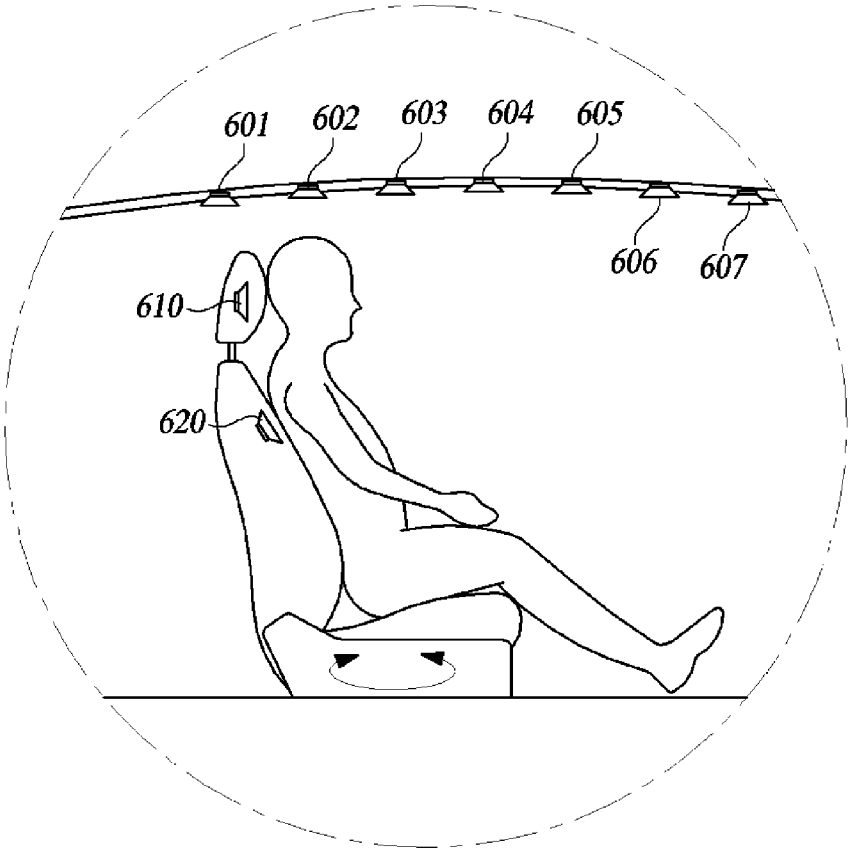
FIG. 10 is a view exemplarily illustrating an example of an additional seat posture according to various exemplary embodiments of the present invention.

FIG. 10 is a view exemplarily illustrating an example of an additional seat posture according to various exemplary embodiments of the present invention.

Referring to FIG. 10, a seat posture according to various exemplary embodiments of the present invention is illustrated. A seat faces the rear of a vehicle.

Among a plurality of roof speakers 601, 602, 603, 604, 605, 606, and 607, a headrest speaker 610, and a backrest speaker 620, a sound control apparatus may determine a speaker to output a sound based on the seat posture information and an audio mode.

The sound control apparatus may adjust a sound pressure level and a frequency band of a speaker to output a sound based on the seat posture information and the audio mode.

Figure 11:
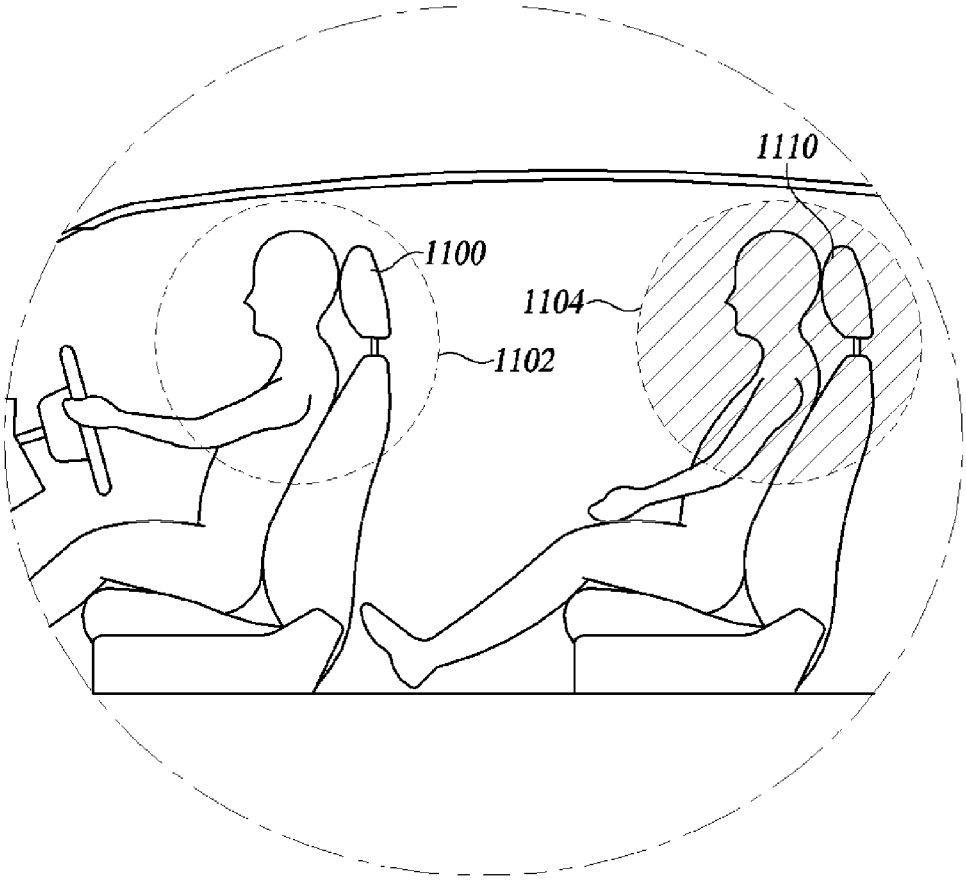
FIG. 11 is a view exemplarily illustrating an example of a region through which a sound of a speaker is output according to various exemplary embodiments of the present invention.

FIG. 11 is a view exemplarily illustrating an example of a region through which a sound of a speaker is output according to various exemplary embodiments of the present invention.

Referring to FIG. 11, a driver's seat 1100, a head position 1102 of a driver, a backseat 1110, and a head position 1104 of a passenger are illustrated.

According to various exemplary embodiments of the present invention, a sound control apparatus may generate a control signal to output a sound output by at least one speaker in a vehicle to a head position of an occupant based on seat posture information and an audio mode.

The sound control apparatus may generate a control signal to control a sound output by at least one speaker to reach the head position 1102 of the driver. The at least one speaker outputs the sound to reach the head position 1102 of the driver according to constructive interference generated based on the generated control signal.

According to various exemplary embodiments of the present invention, the sound control apparatus may generate a control signal to control a sound output by at least one speaker in the vehicle to reach the head position of the occupant and not to reach a region excluding the head position of the occupant, based on the seat posture information and the audio mode.

The sound control apparatus may generate a control signal to control a sound output by at least one speaker to reach the head position 1102 of the driver and the sound not to reach the head position 1104 of the passenger. At least one speaker outputs a sound to the head position 1102 of the driver according to constructive interference generated based on the control signal. Furthermore, at least one speaker outputs a sound to the head position 1104 of the passenger according to destructive interference generated based on the control signal. The passenger does not recognize the sound due to the destructive interference.

As described above, the sound control apparatus may implement an independent sound field mode, a voice curtain mode, a privacy call mode, and the like using constructive interference and destructive interference. The sound control apparatus may further use a beam forming technology.

Figure 12:
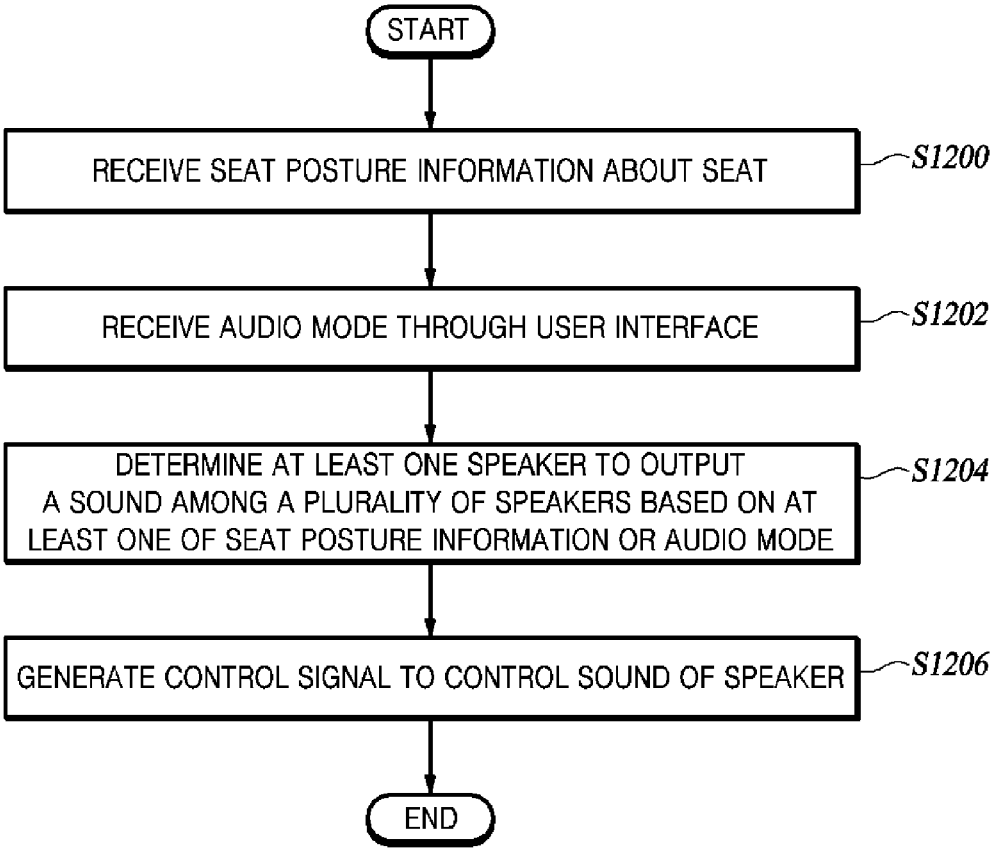
FIG. 12 is a flowchart illustrating an example of a method of controlling a sound according to various exemplary embodiments of the present invention.

FIG. 12 is a flowchart illustrating an example of a method of controlling a sound according to various exemplary embodiments of the present invention.

Referring to FIG. 12, the sound control apparatus receives seat posture information related to a seat occupied by an occupant among seats in the vehicle (S1200).

The sound control apparatus may receive the seat posture information using a sensor provided in the vehicle or a sensor provided in the seat.

The seat posture information includes at least one of a seat position, a seat height, a sliding position, a backrest angle, or a seat rotation angle.

The sound control apparatus receives an audio mode from the occupant through a user interface (S1202).

The audio mode denotes any one among a basic mode, a road surface noise canceling mode, an independent sound field mode, a voice curtain mode, a privacy call mode, an NVH canceling mode, or a noise canceling mode.

Among the plurality of speakers in the vehicle, the sound control apparatus determines at least one speaker to output a sound based on at least one of the seat posture information or the audio mode (S1204).

In the instant case, the plurality of speakers include one or more among the door speaker, the roof speaker, the headrest speaker, the backrest speaker, the front speaker, or the rear speaker.

According to various exemplary embodiments of the present invention, the sound control apparatus may determine the at least one speaker with reference to a look-up table defining at least one speaker corresponding to at least one of the seat posture information or the audio mode.

According to various exemplary embodiments of the present invention, a sound control apparatus may estimate a head position of the occupant based on seat posture information and determine at least one speaker based on distances between the head position of the occupant and a plurality of speakers. The sound control apparatus may further consider an audio mode when determining at least one speaker to output the sound.

The sound control apparatus generates a control signal to control the sound output by at least one speaker (S1206).

According to various exemplary embodiments of the present invention, the sound control apparatus may generate a control signal to make at least one speaker output a sound at a preset sound pressure level in a preset frequency band. The preset sound pressure level and the preset frequency band correspond to at least one of the seat posture information or the audio mode.

According to various exemplary embodiments of the present invention, a sound control apparatus may generate a control signal based on a distance between a head position of the occupant and at least one speaker. The sound control apparatus may further consider an audio mode when generating a sound control signal.

The sound control apparatus may generate a control signal to control at least one speaker to output a sound at a higher sound pressure level as the at least one speaker is close to the head position of the occupant.

The sound control apparatus may generate a control signal to control at least one speaker to output a sound in a lower frequency band as the at least one speaker is close to the head position of the occupant.

The sound control apparatus may also generate a control signal to control at least one speaker to output a sound in a wider frequency band as the at least one speaker is close to the head position of the occupant.

The sound control apparatus may generate a control signal to control a sound output by at least one speaker to reach the head position of the occupant according to the seat posture information and the audio mode. The audio mode may be one of a road surface noise canceling mode, an independent sound field mode, a voice curtain mode, a privacy call mode, an NVH canceling mode, or a noise canceling mode.

The sound control apparatus may generate a control signal to control a sound output by at least one speaker to reach the head position of the occupant and not to reach a region excluding the head position of the occupant, according to the seat posture information and the audio mode. The audio mode may be one of a road surface noise canceling mode, an independent sound field mode, a voice curtain mode, a privacy call mode, an NVH canceling mode, or a noise canceling mode.

Although it is described in FIG. 12 that operations S1200 to S1206 are sequentially executed, the present merely illustrates the technical idea of various exemplary embodiments of the present invention. In other words, those having ordinary skill in the Field of the Invention to which various exemplary embodiments of the present invention belongs may change the order described in FIG. 12 within a range that does not deviate from the essential characteristics of various exemplary embodiments of the present invention. Alternatively, those having ordinary skill in the technical field may apply various modifications and variations to execute one or more of the operations S1200 to S1206 in parallel. Thus, FIG. 12 is not limited to a time-series order. The above modifications and variations should be within the scope of the present invention.

Meanwhile, the operations illustrated in FIG. 12, as well as the apparatus including the various units identified above and in FIG. 4, may be implemented as computer-readable codes on a computer-readable recording medium. The computer readable recording medium may include all kinds of recording apparatuses in which data which may be read by a computer system is stored. In other words, the computer-readable recording medium may be a non-transitory medium, such as a read-only memory (ROM), a random-access memory (RAM), a compact disc (CD)-ROM, a magnetic tape, a floppy disk, and an optical data storage device. The computer readable recording medium may further include a transitory medium such as a carrier wave (for example, transmission over the Internet) and a data transmission medium. Furthermore, the computer readable recording media may be distributed in computer systems connected to each other through a network such that the computer readable codes may be stored and executed in the computer readable recording media in a distributed scheme.

Furthermore, components of the present invention may use an integrated circuit structure, such as a memory, a processor, a logic circuit, a look-up table, and the like. These integrated circuit structures execute each of the functions described herein through the control of one or more microprocessors or other control devices. Furthermore, components of the present invention may be implemented by a program or a portion of a code that includes one or more executable instructions for performing a specific logical function and is executed by one or more microprocessors or other control devices. Furthermore, components of the present invention may include or be implemented as a Central Processing Unit (CPU), a microprocessor, and the like that performs respective functions. Furthermore, components of the present invention may store instructions executed by one or more processors in one or more memories.

As described above, according to various exemplary embodiments of the present invention, it is possible to determine at least one speaker for outputting a sound according to a seat posture, and control the sound of the speaker.

According to various exemplary embodiments of the present invention, it is possible to determine at least one speaker for outputting a sound according to a seat posture and an audio mode, and control the sound of the speaker.

According to various exemplary embodiments of the present invention, it is possible to provide independent sound services to passengers in a vehicle according to a seat posture and an audio mode.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A method of controlling a sound using an audio system in a vehicle, the method comprising:

receiving seat posture information related to a seat occupied by an occupant among seats in the vehicle;

determining at least one speaker to output a sound among a plurality of speakers provided in the vehicle according to the seat posture information; and generating a control signal to control the sound output by the at least one speaker according to the seat posture information, wherein the determining of the at least one speaker includes:

receiving an audio mode from the occupant through a user interface; and determining the at least one speaker according to the seat posture information and the audio mode, and wherein the generating of the control signal includes generating the control signal to control the sound output from the at least one speaker to reach a head position of the occupant and not to reach a region excluding the head position of the occupant, according to the seat posture information and the audio mode.

2. The method of claim 1, wherein the at least one speaker is determined with reference to a look-up table defining at least one speaker corresponding to the seat posture information.

3. The method of claim 1, wherein the generating of the control signal includes:

generating the control signal to make the at least one speaker output the sound at a preset sound pressure level in a preset frequency band, wherein the preset sound pressure level and the preset frequency band correspond to the seat posture information.

4. The method of claim 1, wherein the determining of the at least one speaker includes:

estimating the head position of the occupant according to the seat posture information; and determining the at least one speaker according to distances between the head position of the occupant and the plurality of speakers.

5. The method of claim 4, wherein the generating of the control signal includes:

generating the control signal based on a distance between the head position of the occupant and the at least one speaker.

6. The method of claim 5, wherein the generating of the control signal includes generating the control signal to control the at least one speaker to output the sound at a higher sound pressure level as the at least one speaker is close to the head position of the occupant.

7. The method of claim 5, wherein the generating of the control signal includes generating the control signal to control the at least one speaker to output the sound in a lower frequency band as the at least one speaker is close to the head position of the occupant.

8. The method of claim 1, wherein the generating of the control signal includes generating the control signal to control the at least one speaker to output the sound in a wider frequency band as the at least one speaker is close to the head position of the occupant.

9. The method of claim 1, wherein the generating of the control signal includes generating the control signal to control the sound output from the at least one speaker to reach the head position of the occupant, according to the seat posture information and the audio mode.

10. A sound control apparatus including:

a receiving unit configured to receive seat posture information related to a seat occupied by an occupant among seats in a vehicle, and an audio mode from the occupant; and a control unit configured to determine at least one speaker to output a sound among a plurality of speakers provided in the vehicle according to the seat posture information and generate a control signal to control the sound output by the at least one speaker according to the seat posture information, wherein the control unit is configured to determine the at least one speaker according to the seat posture information and the audio mode, and wherein the control unit is configured to generate the control signal to control the sound output from the at least one speaker to reach a head position of the occupant and not to reach the sound through a region excluding the head position of the occupant, according to the seat posture information and the audio mode.

11. The sound control apparatus of claim 10, wherein the control unit is configured to determine the at least one speaker with reference to a look-up table defining at least one speaker corresponding to the seat posture information.

12. The sound control apparatus of claim 10, wherein the control unit is configured to generate the control signal to make the at least one speaker output the sound at a preset sound pressure level and a preset frequency band, and wherein the preset sound pressure level and the preset frequency band correspond to the seat posture information.

13. The sound control apparatus of claim 10, wherein the control unit is configured to:

estimate the head position of the occupant according to the seat posture information; and determine the at least one speaker according to distances between the head position of the occupant and the plurality of speakers.

14. The sound control apparatus of claim 13, wherein the control unit is configured to generate the control signal based on a distance between the head position of the occupant and the at least one speaker.

15. The sound control apparatus of claim 14, wherein the control unit is configured to:

generate the control signal to control the at least one speaker to output the sound at a higher sound pressure level as the at least one speaker is close to the head position of the user; and generate the control signal to control the at least one speaker to output the sound in a lower frequency band as the at least one speaker is close to the head position of the occupant.

16. The sound control apparatus of claim 10, wherein the control unit is configured to generate the control signal to control the at least one speaker to output the sound in a wider frequency band as the at least one speaker is close a head position of the occupant.

* * * * *